US010709167B2

(12) United States Patent
Emmet

(10) Patent No.: US 10,709,167 B2
(45) Date of Patent: Jul. 14, 2020

(54) METHOD AND SYSTEM FOR WRAPPING AN ASSEMBLY OF SEGMENTS

(71) Applicant: PHILIP MORRIS PRODUCTS S.A., Neuchatel (CH)

(72) Inventor: Robert William Emmet, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 815 days.

(21) Appl. No.: 14/907,020

(22) PCT Filed: Aug. 13, 2014

(86) PCT No.: PCT/EP2014/067297

§ 371 (c)(1),
(2) Date: Jan. 22, 2016

(87) PCT Pub. No.: WO2015/022347

PCT Pub. Date: Feb. 19, 2015

(65) Prior Publication Data

US 2016/0157518 A1 Jun. 9, 2016

(30) Foreign Application Priority Data

Aug. 14, 2013 (EP) ..... 13180463

(51) Int. Cl.
*A24C 5/10* (2006.01)
*A24C 5/47* (2006.01)

(52) U.S. Cl.
CPC ..... *A24C 5/10* (2013.01); *A24C 5/47* (2013.01); *A24C 5/471* (2013.01)

(58) Field of Classification Search
None
See application file for complete search history.

(56) References Cited

U.S. PATENT DOCUMENTS 2,162,424 A 6/1939 Edwards
2,821,199 A 1/1958 Korber
(Continued)

FOREIGN PATENT DOCUMENTS

CN 1718121 1/2006
CN 1750766 3/2006
(Continued)

OTHER PUBLICATIONS

PCT Search Report and Written Opinion for PCT/EP2014/067297 dated Apr. 22, 2015 (17 pages).

*Primary Examiner* — Michael J Felton
*Assistant Examiner* — Katherine A Will
(74) *Attorney, Agent, or Firm* — Mueting Raasch Group

(57) ABSTRACT

In the method and system for wrapping an assembly (5) of segments, an outer periphery of the assembly is affixed longitudinally to an edge portion of a piece of wrapping material (50) and at least one of the segments of the assembly is a rigid segment with a compressibility higher than about 10 Newton per 1.5 mm. The assembly of segments is provided to a rolling seat (10) arranged in the peripheral surface of a wrapping conveyor (1). A retaining surface (202) is arranged at a distance and opposite the peripheral surface of the wrapping conveyor, such as to contact the assembly supplied to the rolling seat with the retaining surface. The assembly of segments are wrapped by moving the wrapping conveyor relative to the retaining surface thereby creating a relative movement between the wrapping conveyor and the retaining surface such as to cause rotation of the assembly in the rolling seat along a longitudinal axis of the assembly and by providing the assembly of segments with a three-point guiding contact while moving the assembly of segments along the retaining surface.

6 Claims, 1 Drawing Sheet

(56) References Cited

U.S. PATENT DOCUMENTS

Figure 1:
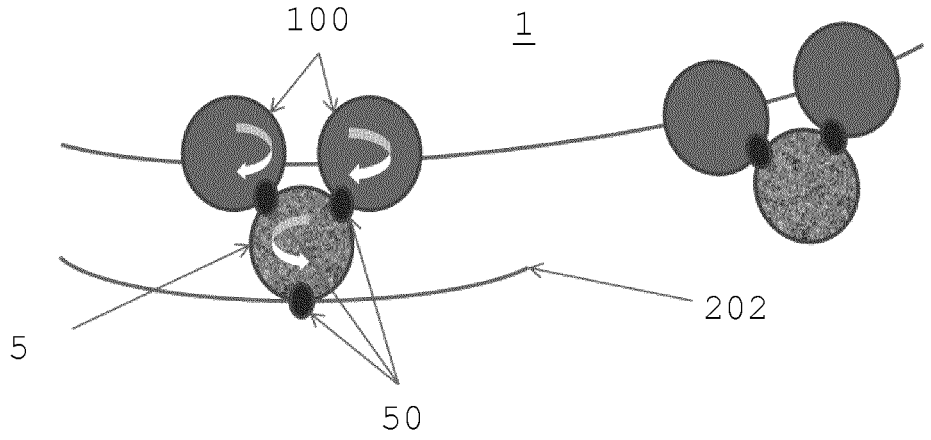

| | | | | |
|---|---|---|---|---|
| 3,348,552 | A | 10/1967 | McCarthy | |
| 3,380,459 | A | 4/1968 | Schmermund | |
| 6,119,698 | A * | 9/2000 | Tanigawa ..... | A24C 5/471 131/88 |
| 2006/0081443 | A1 | 4/2006 | Pawelko | |
| 2006/0169295 | A1 | 8/2006 | Draghetti | |
| 2006/0201525 | A1 | 9/2006 | Meins | |

FOREIGN PATENT DOCUMENTS

| | | |
|---|---|---|
| CN | 1759773 | 4/2006 |
| CN | 1830339 | 6/2010 |
| CN | 101856146 | 10/2010 |
| CN | 1742639 | 10/2011 |
| CN | 101442917 | 8/2012 |
| CN | 102871220 | 8/2016 |
| EP | 0124289 | 8/1987 |
| EP | 0722672 | 9/1999 |
| EP | 2545791 | 3/2015 |
| GB | 457033 | 11/1936 |
| GB | 1146206 | 3/1969 |
| WO | WO 2007/110650 | 10/2007 |
| WO | WO 2013/034652 | 3/2013 |

* cited by examiner

METHOD AND SYSTEM FOR WRAPPING AN ASSEMBLY OF SEGMENTS

This application is a U.S. National Stage Application of International Application No. PCT/EP2014/067297, filed Aug. 13, 2014, which was published in English on Feb. 19, 2015 as International Patent Publication WO 2015/022347 A2. International Application No. PCT/EP2014/067297 claims priority to European Application No. 13180463.5 filed Aug. 14, 2013.

The invention relates to a method and system for wrapping an assembly of segments. Especially, it relates to a method and system for wrapping an assembly of segments for use in the manufacture of rod shaped articles such as smoking articles.

It is known from prior art wrapping systems for cigarettes to secure a tobacco rod to a filter element by tipping the tobacco rod and the filter element with a piece of wrapping paper. For example, European patent application EP-A-0722672 describes a wrapping system where the tobacco rod and the filter element are aligned in a flute of a rotating fluted drum. For wrapping, the tobacco rod and the filter element are pushed out of their flute and are made to roll over the piece of wrapping paper provided with adhesive. However, the individual segments leaving the flute may become misaligned. This risk is greater the more segments are comprised in an assembly of segments. Additionally, it is sometimes desired to produce smoking articles made from substantially cylindrical segments that have a hardness that is greater than the hardness of an acetate tow filter or a tobacco rod, for example segments that are or comprise non-cuttable objects such as a flow restrictor as described for example in international patent application WO-A-2013/034652. Due to the greater hardness of such segments a tight and unwrinkled wrapping is complicated on machines as described in the state of the art.

Therefore, there is a need to provide a method and system that provide a reliable wrapping of assemblies of segments for smoking articles.

According to a first aspect of the present invention, there is provided a method for wrapping an assembly of segments to secure the segments of the assembly to each other. Therein the segments are arranged in an end-to-end relationship. An outer periphery of the assembly is affixed longitudinally to an edge portion of a piece of wrapping material. The method comprises the step of supplying the assembly of segments provided with the piece of wrapping material to a rolling seat arranged in the peripheral surface of a wrapping conveyor and the step of arranging a retaining surface at a distance and opposite the peripheral surface of the wrapping conveyor, such as to contact the assembly supplied to the rolling seat with the retaining surface. The method further comprises the step of wrapping the assembly of segments with the piece of wrapping material. Therein, wrapping comprises the steps of moving the wrapping conveyor relative to the retaining surface. Thereby a relative movement between the wrapping conveyor and the retaining surface is created such as to cause rotation of the assembly in the rolling seat along a longitudinal axis of the assembly. Wrapping further comprises the step of providing a three-point guiding contact while moving the assembly of segments along the retaining surface.

In the method according to the invention, an assembly of segments arranged in the rolling seat is contacted in at least three contact locations while being wrapped with a piece of wrapping material. While the assembly is rotated in the rolling seat and thereby wrapped with the piece of wrapping material, the assembly is contacted by the rolling seat the assembly is arranged in and by the retaining surface arranged opposite the rolling seat. The contact locations are distanced from each other and are arranged such as to lie on a circumference of the assembly of segments. Preferably, the circumferentially arranged contact locations are arranged at a same longitudinal position relative to a length of the assembly and preferably along the entire length of the assembly. Preferably, the rolling seat provides two guiding contacts and the retaining surface provides one guiding contact. Depending on the arrangement and design of the rolling seat, also further guiding contacts may be provided by the rolling seat. By a three-point guiding contact, a secure and safe guiding and wrapping under controlled condition is provided to an assembly of segments in a rolling seat. This makes the wrapping method and apparatus according to the invention especially suitable for assemblies of 3 to 6 segments and for rigid segments or for a combination of both. In the handling of assemblies of segments comprising two or more segments, special care has to be taken in order not to cause misalignment of the individual segments of the assemblies, particularly during removal of the assemblies from their seat for a wrapping process. In addition, such a removal process often relies on a certain compressibility of the assembly to be removed from a seat, which is not or only to a limited extent the case where one or several segments of the assembly are rigid segments. Yet further, the wrapping of a piece of wrapping material around a rigid segment or the rolling of a rigid segment along a piece of wrapping paper requires a uniform joining of the assembly with the piece of wrapping material in order to get a uniform wrapping without for example wrinkles or the like. Compared to a more compressible segment, such as, for example, a tobacco rod, a rigid segment does not allow for a compensation of wrapping material by the flexible material of the segment or the assembly of segments. Typically, tobacco rods and acetate tow filter plugs are slightly squeezed during the rolling operation. After the rolling operation the pressure is released and the compressible material attempts to adjust to its previous expanded form, thereby stretching a wrapper to the extent possible, thus creating a neat, smooth outer surface of the wrapper. This effect cannot be achieved with a substantially rigid and incompressible segment. Accordingly, particular care has to be taken to achieve a smooth and tight wrapping around such rigid segments. This is achieved according to the invention by using a three point contact surface of the segments which allows better control over the position of the segments while the wrapping material is wrapped around the assembly. In particular, the wrapping material is always kept taught around the outer surface of the assembly due to the constant pressure that can be applied at three points at the same time.

Examples for rigid elements are ceramic filter elements or filter segments made of hard plastic materials or segments comprising metal, carbon or ceramics structures.

In the method according to the invention wrapping of the assembly occurs in the rolling seat, in which the assembly rotates. Such a rotation of the assembly is basically independent of a moving speed of the wrapping conveyor. Therefore, the speed of rotation of the assembly around its longitudinal axis may be much less than an operational speed of the wrapping conveyor. A slow and reliable wrapping may thus be provided at high overall production rates. Preferably, the speed of rotation of an assembly may be adapted by varying the speed difference of rolling drum and retaining surface. While the retaining surface may be stationary, the retaining surface is preferably moved and preferably in substantially the same direction as the moving direction of the wrapping conveyor.

An "assembly of segments" as used herein, describes two or more segments, preferably between about 2 to 6 substantially cylindrical segments that are aligned in an end-to-end relationship. In most instances, the end-to-end relationship means that the segments abut to each other, however, in some embodiments, the segments may have intended random or predetermined gaps between neighboring segments. An assembly may be for example a smoking article, a filter for a smoking article, a section of smoking articles or an intermediate product such as a double rod for a smoking article that is severed later to create two smoking articles.

The term "segment" is used to refer to an element of the assembly with defined boundaries. Examples for segments The individual segments of the assembly may have a longitudinal extension, which is larger than a radial extension. Preferably, the segments are rod-shaped. Preferably, the segments have a substantially circular cross section. Preferably, an assembly or the segments of an assembly of segments have at least one of a different flexibility, a different hardness, a different compressibility and a different shape. The segments of an assembly may for example be cuttable or uncuttable. Preferably, a non-uniform characteristic of an assembly is found along a length of the assembly or along a length of one or several segments of the assembly. For example a non-uniform firmness may be present in a filter element made of filter tow containing a capsule. Preferably, segments of an assembly of segments are made of or contain different materials such as for example carbonaceous or ceramic material, cardboard material, metals, filter tow, tobacco or tobacco containing material, plant leaf material or combinations thereof.

Preferably, the segments of the assembly of segments are used in the manufacture of smoking articles such as for example tobacco containing segments, filter elements or filter segments to be used in a filter element, a heat source or expansion segments as used in the manufacture of smoking articles that comprise tobacco plugs, wherein solid tobacco or liquid tobacco or other extracts are heated to generate aerosols.

According to an aspect of the method according to the invention, the assembly is rotated at least 1.2 times about its longitudinal axis while the assembly is arranged in the rolling seat. By rotating the assembly at least a bit more than one full rotation a wrapping material is at least entirely wrapped around the assembly of segments. Preferably, the assembly is rotated at least 1.2 times about its longitudinal axis while the assembly is in contact with and is moved along the retaining surface. By this, the wrapping of the assembly may be completed while the assembly is in contact with the retaining surface. Since the assembly is provided with a three point guiding contact while in contact with the retaining surface, the assembly is thus guided and controlled during the entire wrapping process.

According to another aspect of the method according to the invention, the method further comprises the step of adapting the retaining surface and a surface of the rolling seat contacting the assembly such as to avoid slippage between segments of the assembly and the rolling seat.

Slippage may be avoided between segments of the assembly and the rolling seat or between the piece of wrapping paper and the rolling seat, respectively, depending on the wrapping status of the assembly of segments. If slippage is avoided, a better guidance of the assembly may be provided, while the assembly is arranged in the seat. By this, a better control of the wrapping process may be achieved and thus an even and regular wrapping of the assembly is further supported. Avoiding slippage may for example be achieved by providing surfaces with high grip, such as a rough surface or a surface with high friction. Examples for surfaces with enhanced grip are rubber surfaces, low tack surfaces or grooved surfaces. If the rolling seat is provided with a rolling element realized in the form of rollers, for example a pair of rollers, then the outer surface of the rollers is provided with a high grip. If the enhanced grip or the avoiding of slippage, respectively, is realized in the form of a surface structure, then the structure may have an orientation. Preferably, such an orientation is arranged in a direction perpendicular to a rotational direction of rollers.

According to a further aspect of the method according to the invention, the method further comprises the step of keeping a pressure applied to the assembly by the retaining surface substantially constant. A substantially constant force applied to the assembly further supports a uniform wrapping. Assemblies to be wrapped may for example have varying diameters or irregular diameters such as assemblies or segments having an oval diameter. Therefore, the retaining surface may be designed or arranged such as to equalize a pressure onto an assembly of segments. For example the distance between the assembly in the rolling seat and the retaining surface may be varied according to the varying thickness or diameter of the assembly being wrapped. A retaining surface may for example be provided with a pressure applicator, such as for example flexible cantilevers pushing against the retaining surface in the area where the retaining surface contacts the assembly. If the retaining surface is for example part of a conveyor belt, for example an endless belt, a pressure applicator may also for example be a nip roller. A pressure application may also be provided for applying a variable pressure onto an assembly while the assembly is being wrapped. For example an enhanced pressure may be exerted onto a specific location on the periphery of the assembly, preferably to secure adhesion of the piece of wrapping material.

According to another aspect of the method according to the invention, the method further comprises the step of ending contact of the assembly with the retaining surface after complete wrapping of the assembly and before releasing the wrapped assembly from the wrapping conveyor. Since the retaining surface is provided for supporting the wrapping process, a contact with the retaining surface may be ended after the assembly has been completely wrapped. If required, the wrapped assembly may further be held in the rolling seat for example by other retention means. Retention means may for example be suction applied to the rolling seat or a guiding rail guiding the wrapped assembly along the guiding rail and in the rolling seat. Retention means are preferably provided until the assembly is released from the wrapping conveyor. Retention means are especially suitable if the wrapping conveyor is a rolling drum and a wrapped assembly would otherwise fall out of the rolling seat before intended to leave the seat. The wrapped assembly may for example be released from the wrapping conveyor and be transferred to a receiving conveyor, such as a receiving drum for a further transport of the wrapped assembly. The assembly may also be transferred for example into a reservoir or storage device for storing the wrapped assembly until further use.

According to an aspect of the method according to the invention, the method comprises the step of applying suction to the rolling seat for retaining the assembly in the rolling seat between a supply location, where the assembly is supplied to the wrapping conveyor and a release location, where the wrapped assembly is released from the wrapping conveyor.

The assembly may be taken into and kept in the rolling seat by suction. Preferably suction is interrupted as soon as a retaining surface comes into contact with the assembly further downstream of a supply location (when seen in a moving direction of the assembly in the rolling drum). Especially by interrupting suction while the assembly is being wrapped, a rotation of an assembly during wrapping is not influenced by suction. After the assembly has ended contact with the retaining surface suction may be applied to the seats again until the assembly is released from the seat.

Where gravitational force acts on the assembly in a way such that the assembly is kept in the rolling seat, the provision of suction to the rolling seat may be omitted. For example, suction may be omitted when using a horizontally arranged wrapping conveyor with the assembly arranged on an upper side of the wrapping conveyor. Preferably, suction to a rolling seat is applied when using a rolling drum as wrapping conveyor. If required, suction may also be applied during the entire period, in which the assembly is arranged in the rolling seat.

According to another aspect of the method according to the invention, at least one of the segments of the assembly of segments is a rigid segment with a compressibility higher than about 10 Newton per 1.5 mm and preferably, less than about 100 Newton per 1.5 mm. Preferably, the compressibility of at least one of the segments is between about 20 Newton per 1.5 mm and about 100 Newton per 1.5 mm and more preferably between about 50 Newton per 1.5 mm and about 100 Newton per 1.5 mm.

The compressibility of a segment can be measured in a compression test in which the segment is placed on a substantially flat support surface and a force is applied in a downwards direction on one side of the segment using a head having a flat, 12 mm round surface moving at a speed of 100 mm per minute. A suitable apparatus for conducting such a test is the FMT-310 Force Tester of Alluris GmbH. Prior to testing, the segment is conditioned for 24 hours at a temperature of 22 degree Celsius and a relative humidity of 55 percent before the compression test is carried out. The test is continued until the insert has been compressed 1.5 mm. The force (Newton) at this point is the compressibility. If the test is unable to continue to 1.5 mm compression, the force can be normalized to 1.5 mm. In other words, if the maximum compressive force is 28 Newton and the compression at this maximum compression is 1.4 mm, the reported value for compressibility will be 30 Newton per 1.5 mm (28 Newton divided by 1.4 multiplied by 1.5). In some embodiments the segment is brittle and will not compress at all, for example a ceramic or carbonaceous segment, but the segment will instead shatter. In such an embodiment the compressibility is substantially infinite as the segment will rather break than compress. In other embodiments the compressibility of the segment is not monotonous, for example in a filter segment that comprises a capsule that is dispersed in the filtration material. In such a case, the segment is at first easily compressible as long as the filtration material is compressed, for example acetate tow. Then, the compressibility is reduced when the capsule is reached. Then, after the capsule breaks, the compressibility is increased again.

A rigid segment is basically non-compressible or non-flexible upon compression in comparison to at least partly flexible segments such as for example tobacco rods or filter elements made of filter tow. Such flexible segments allow a certain equalization of a wrapping material, for example to even out wrinkles created upon wrapping. Since rigid elements do not provide for such equalization, the controlled wrapping method of the present invention is particularly suitable for wrapping assemblies comprising at least one or entirely consists of rigid elements.

According to another aspect of the invention there is provided a system for wrapping an assembly of segments. The system comprises a supply conveyor, a wrapping conveyor and a retaining surface. The supply conveyor is adapted for supplying an assembly of segments to the wrapping conveyor. The assembly of segments comprises at least two segments arranged in an end-to-end relationship with an outer periphery of the assembly being affixed longitudinally to an edge portion of a piece of wrapping material. The wrapping conveyor comprises a rolling seat arranged in the peripheral surface of the wrapping conveyor, which rolling seat is movable with the wrapping conveyor. The rolling seat comprises a rolling element rotatable relative to the wrapping conveyor for rotating the assembly in the seat. The retaining surface is arranged at a distance to and opposite of the peripheral surface of the wrapping conveyor such as to contact the assembly arranged in the seat of the wrapping conveyor. The wrapping conveyor is movable relative to the retaining surface adapted to create a relative movement between the wrapping conveyor and the retaining surface such as to cause rotation of the assembly in the rolling seat along a longitudinal axis of the assembly. Thereby the assembly is being wrapped with the piece of wrapping material while the assembly is movable along the retaining surface. Preferably the retaining surface is moveable substantially in the same direction as the wrapping conveyor.

Seat rollers may accommodate and support the assembly of segments, preferable along the entire length of the assembly. Seat rollers, especially driven seat rollers make the assembly in the rolling seat rotate around its longitudinal axis. A rotational speed of the assembly or a wrapping speed, respectively, may be adapted by varying the driving speed of the seat rollers. The two seat rollers provide two guiding contacts while the assembly is being wrapped, while the retaining surface provides the third guiding contact for the assembly.

Further advantages of the system have been described above referring to the method according to the invention and will therefore not be repeated.

According to an aspect of the system according to the invention, the system further comprises a retaining device arranged in the wrapping conveyor for retaining the assembly in the rolling seat. Such a retaining device may for example be a suction chamber arranged in the wrapping conveyor with fluid connection from the suction chamber to the rolling seat for applying suction to the rolling seat. Such retaining device may be arranged to provide a retaining action onto the assembly during the entire period an assembly is arranged in a rolling seat of the wrapping conveyor. However, a retaining device is preferably arranged to provide no retaining action, while an assembly is in contact with the retaining surface. By this, a wrapping process may solely be controlled by the interaction of rolling seat and retaining surface.

According to an aspect of the system according to the invention, the rolling element comprises a pair of rollers arranged parallel to each other, which are rotatable in a same direction, and are arranged perpendicular to a moving direction of the wrapping conveyor. In case of the wrapping conveyor being a conveyor drum, the pair of rollers is arranged perpendicular to a rotating direction of the conveyor drum.

Each of the rollers of the pair of rollers provide a guiding contact point or contact line preferably along the entire length of the assembly arranged in the rolling seat between the two rollers. In addition, the pair of rollers may urge the assembly to rotate around its own longitudinal axis while guiding the assembly with the two contact points. This rotational movement makes the piece of wrapping material to wrap around the assembly. Both rollers of the pair of rollers may be driven rollers. The third contact point or contact line, respectively, is provided by the retaining surface arranged opposite the rolling seat or opposite the rollers. The three guiding contacts may be arranged substantially equidistantly along the circumference of the assembly. Preferably, the contact point of the retaining surface lies opposite and on an imaginary middle axis of the two rollers.

According to another aspect of the system according to the invention, the retaining surface is a surface of an endless belt. An endless belt is a simple way of realizing a movable retaining surface. An endless belt requires low material cost and maintenance. In addition, an endless belt is typically elastic and provides sufficient flexibility to allow a gentle contacting of an assembly with the surface of the belt that can limit the compression of the segments.

According to yet a further aspect of the system according to the invention, the system further comprises a pressure applicator for applying a pressure to the retaining surface. Preferably the pressure applicator is designed to apply a constant pressure to the assembly. By applying pressure, especially constant pressure, a variation in a cross section of the assembly may be equalized and it may be prevented that an assembly is contacted with too much force or that contact with the retaining surface is lost. A pressure applicator may also be provided to apply a high force to support the safe adhesion of a wrapping material on the assembly. Preferably, such a high force is applied to the assembly only temporarily and preferably at one location in the area of the end of the retaining surface only.

The system according to the invention may comprise further means to support wrapping of the assembly of segments. For example heating means may be provided to heat an adhesive on the piece of wrapping material to support a more uniform affixing of the wrapping material at the assembly or curing an adhesive for a faster wrapping. Heating means may be internal or external heating means. Internal heating means are for example a heated belt or a heated wrapping conveyor. External heating means may for example be heat rollers or radiant heaters. Such external heaters may for example be arranged below the retaining surface, for example below a conveyor belt. Preferably, a conveyor belt is designed to allow heat to pass through the belt or to conduct heat such as for example a belt material in the form of a mesh or chain.

According to another aspect of the system according to the invention, the retaining surface and a surface of the rolling seat are surfaces adapted to avoid slippage between segments of the assembly of segments and the rolling seat.

According to yet another aspect of the system according to the invention, a plurality of rolling seats is arranged preferably equidistantly in the peripheral surface of the wrapping conveyor. By the provision of a plurality of rolling seats the wrapping conveyor may be supplied with a succession of assemblies of segments. This succession of assemblies may then be wrapped continuously while being moved along the retaining surface. By this, the production of wrapped assemblies may be increased and the system and method may be optimized for mass production. This is especially favorable in the manufacture of smoking articles or of parts of smoking articles, such as the manufacture of filters or filter elements for smoking articles.

Figure 2:
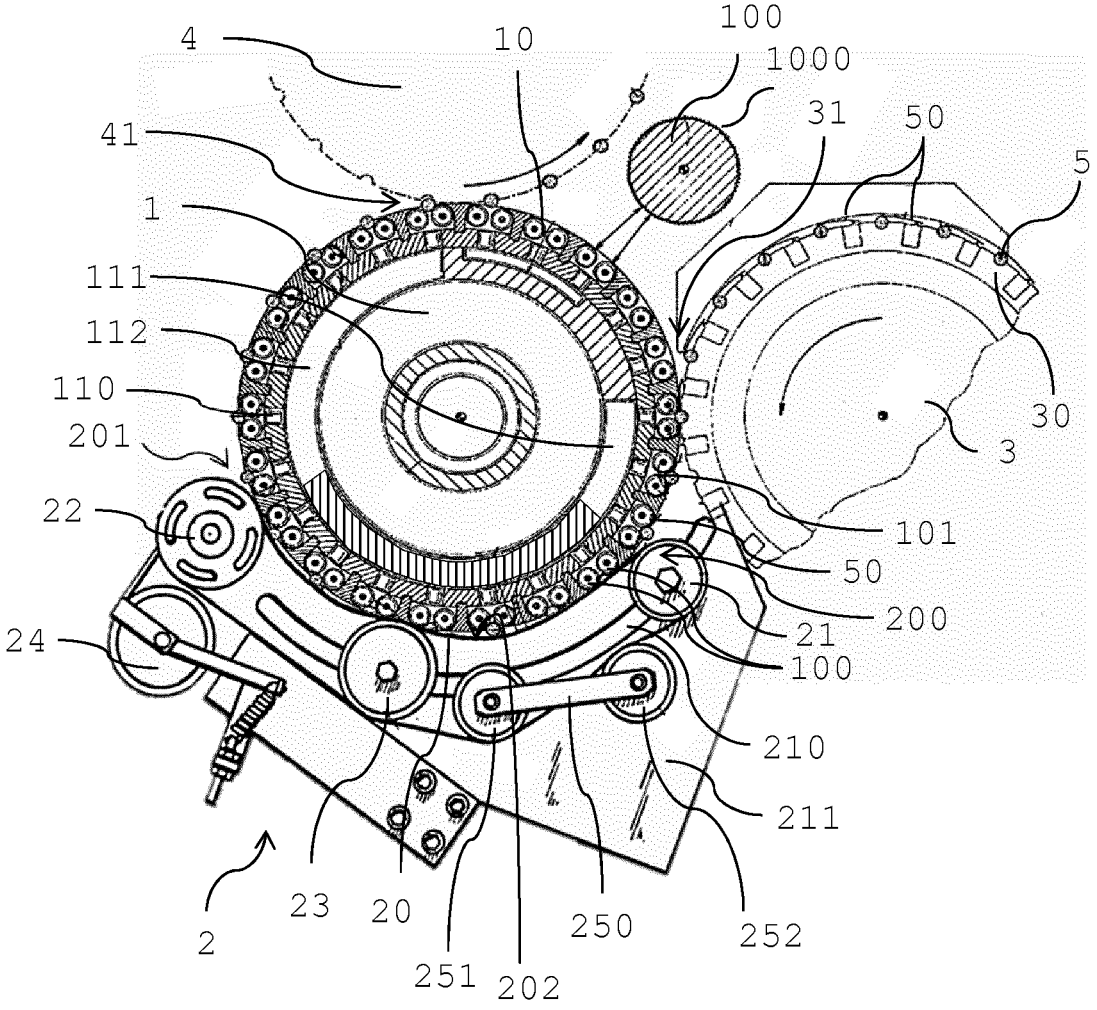

The invention is further described with regard to embodiments, which are illustrated by the following drawings, wherein FIG. 1 shows the principle of a three-point guiding contact upon wrapping of an assembly of segments;

FIG. 2 shows an embodiment of the system according to the invention for carrying out the method according to the invention.

In FIG. 1 an assembly of substantially cylindrical segments 5, for example segments of a smoking article, is arranged in contact with and between two rolling wheels 100, such that the segments of the assembly lie in an end-to-end relation, either abutting with neighboring segments or with a predetermined or random spacing with neighboring segments. The two rolling wheels 100 form part of a rolling seat (not shown) arranged in the periphery of a rolling drum 1, for example a rolling drum 1. Assembly 5 contacts each of the two rolling wheels 100 in one contact location 50. Preferably, the contact location 50 is a contact line extending along the periphery and along the longitudinal extension of assembly 5.

A retaining surface 202, for example the surface of a conveyor belt, is arranged at a distance and substantially parallel to the periphery of rolling drum 1. The distance is chosen and adapted to the diameter of assembly 5. The distance is further chosen such that retaining surface 202 contacts assembly 5 in a third contact location 50. The three contact locations 50 are distanced from each other and are arranged on the circumference of assembly 5. The one contact location by the retaining surface 202 is arranged basically opposite the two other contact locations provided by the two rolling wheels 100. Depending on the arrangement of rolling wheels 100, the three contact locations 50 may be arranged substantially equidistantly on the circumference of assembly 5.

Rolling drum 1 and retaining surface 202 are moved relative to each other. If retaining surface 202 is moved as well, it is preferably moved in a similar direction as wrapping conveyor but preferably not at a same speed. Retaining surface 202 may for example not be moved at all, but is preferably moved at a lower speed than the rotational speed of rolling drum 1. By the relative movement of rolling drum 1 and retaining surface 202, assembly 5 is made to rotate between the two rolling wheels 100 in the rolling seat along its longitudinal axis (perpendicular to the drawing sheet). At the same time assembly 5 is guided by the two rolling wheels 100 and retaining surface 202. One or both of rolling wheels 100 may be driven wheels to make the assembly rotate in the seat or to support such a rotation. The rotational direction of assembly 5 and of rolling wheels 100 are indicated by arrows. Alternatively, the rotation of the assembly 5 occurs solely due to the difference in speed between the rolling drum 1 and the retaining surface 202. In FIG. 1 rolling drum 1 is moved in a clockwise direction. By the rotational movement of assembly 5, a piece of wrapping paper, which is fixed longitudinally to the outer periphery of the assembly (not shown in the drawing) is made to wrap around the assembly 5. An adhesive applied to the piece of wrapping paper enables the paper to remain attached to assembly 5. By the three-point guiding contact such a wrapping is guided and controlled during the entire wrapping process. By this, different kind of segments may be provided in the assembly, and especially also rigid segments are reliably wrapped. In addition, performing wrapping while assembly 5 remains in the rolling seat prevents misalignment of individual segments of assembly 5, which might otherwise occur when rolling several segments freely or without close guidance along a plane.

FIG. 2 shows an embodiment of a system by which a three-point guiding contact upon wrapping of an assembly arranged in a rolling seat may for example be realized.

On a supply drum 3 a plurality of assemblies of segments 5 are held, preferably by suction. Assemblies 5 may for example comprise at least two segments as used in the manufacture of smoking articles. Each assembly 5 presents on its outer periphery a projecting strip of wrapping material 50 fixed to the assembly. The segments of assembly 5 are arranged in an end-to-end relationship on supply drum 3 in respective seats 30. Supply drum 3 rotates anticlockwise as indicated by an arrow. The assemblies provided with the piece of paper are supplied to the rolling drum 1 at transfer location 31.

After having been wrapped while on the rolling drum 1 the wrapped assemblies 5 are transferred to a receiving drum 4 at transfer location 41 located downstream of transfer location 31. Receiving drum 4 is adapted to successively receive wrapped assemblies 5 from rolling drum 1.

Rolling drum 1 is mounted to rotate clockwise, while receiving drum 4 is mounted to rotate anticlockwise. The rotational axis of the supply drum 3, the rolling drum 1 and the receiving drum 4 are arranged parallel to each other.

Rolling drum 1 presents a number of equally spaced, peripherally arranged rolling seats 10. Each of the rolling seats 10 is adapted to receive, to retain a respective assembly 5 and for releasing the assembly 5 at transfer location 41. Each assembly 5 may be rotated about its longitudinal axis in the rolling seat 10. Strip 50 provided or coated with an adhesive is wrapped around assembly 5 by rolling drum 1 and a retaining surface 202 of a continuous belt 20 to secure the segments of the assembly to each other as described further below.

Rolling seats 10 of rolling drum 1 communicate inwards via holes 110 with vacuum chambers 111,112 provided in the rolling drum. Vacuum chambers 111,112 are connected to suction means as known in the art and provide suction to the rolling seats 10 to retain assembly 5 in seat 10. A first suction chamber 111 extends from transfer location 31 to a contact location 200 of assembly 5 with retaining surface 202. A second suction chamber 112 extends from a contact end location 201 with retaining surface 202 to transfer location 41.

Each rolling seat 10 comprises a pair of rollers 100 which may be driven. The rolling seats rotate clockwise in the shown embodiment. Rollers 100 are separated by a distance approximately equal to but no greater than the diameter of an assembly 5. They define a respective rolling seat 10 communicating with vacuum chambers 111, 112 and respective holes 110 via an opening 101 between the two rollers 100.

Each roller 100 is defined externally by a rough cylindrical surface 1000 (shown in the enlarged view of FIG. 2), preferably an axially knurled surface, where the knurls are preferably arranged substantially tangential to the peripheral surface of rolling drum 1 and retaining surface 202.

In use, assemblies 5 are transferred successively from supply drum 3 to rolling drum 1 at transfer location 31. The assemblies are withdrawn by suction into a respective seat 10 located in rolling drum 1. To simplify a transfer, any vacuum that may have been applied to the assemblies 5 while being on the supply drum 3 is interrupted as transfer location 31.

The suction applied to rolling seats 10 additionally ensures that each assembly 5 is positioned with its outer surface contacting outer surfaces 1000 of rollers 100, once the assembly 5 is positioned to close opening 101 in the respective seat 10. A respective paper strip 50 contacts and rests along the periphery of the rolling drum 1 between two seats 10.

A retaining device 2 providing retaining surface 202 to retain and guide the assemblies 5 in rolling seat 10 during wrapping is arranged between transfer locations 31 and 41. A mounting plate 211 comprises an arcuate slot 210, wherein the rotational axis of rolling drum 1 coincides with the center of curvature of arcuate slot 210. A first roller 21 is mounted in the slot 210. First roller 21 is movable to any desired position along arcuate slot 210 and may be fixed there. Mounting plate 211 may permit a lateral positioning of the mounting plate relative to rolling drum 1 to be adjusted. Mounting plate 211 also supports one end of a bracket 250 mounted thereon to be pivotable about a horizontal axis and carrying at its free end tension rollers 251,252. A spring may bias bracket 250 away from rolling drum 1. An additional pressure roller 24 may also be mounted to mounting plate 210 in a spring biased manner to push pressure roller 24 upwards into the direction of rolling drum 1.

A driver roller 22 is mounted above pressure roller 24. A continuous belt 20 extends in a loop around the first roller 21, over the top of tension roller 252, around tension roller 251, and around driver roller 22. The tension roller 251 is configured such that the belt 20 rests against the periphery of rolling drum 1 in the absence of assemblies on rolling drum 1.

An alternate embodiment comprises an addition of nip roller 23 by which the system according to the invention may be optimized for wrapping assemblies of non-uniform cross sections, such as oval cross-section cigarettes. Nip roller 23 is mounted for rotation beneath endless belt 20 to slightly narrow the gap between belt 20 and rolling drum 1. Nip roller 23 is located along the length of the gap such that each assembly that passes along retaining surface 202 traverses the gap. Preferably, a wrapping paper 50 overlap seam is radially aligned with nip roller 23 at the point where the nip roller 23 makes line contact with belt 20. The slight additional pressure exerted by nip roller 23 is of short duration. The pressure applied to the assembly 5 by the nip roller 23 is exerted substantially only along the wrapping paper overlap seam, and configured to be insufficient to permanently deform assembly 5 from its previous cross-sectional shape or to damage a segment of the assembly, respectively, but large enough to properly adhere the end of the wrapper onto the assembly.

Belt 20 is driven to move in the same direction as the adjacent periphery of the rolling drum 1, but at a different angular speed as measured about the rolling drum axis. As a result of this difference in speed, an assembly 5 in rolling seat 10 of rolling drum 1 and retaining surface 202 of belt 20 is caused to rotate in the seat 10 while being moved forward with rolling drum 1 and arranged between rolling drum 1 and belt 20 by the drum's rotation.

When supply drum 3 transfers assembly 5 to rolling drum 1 a strip of wrapping paper 50 is received within the seat 10 and starts trailing the assembly. To wrap the paper 50 around assembly 5, belt 20 is driven so that its angular speed is less than that of rolling drum 1, causing the assemblies to rotate in seat 10 counterclockwise in FIG. 2. The instant each assembly 5 contacts surfaces 1000 of rolling wheels 100 and retaining surface 202, assembly 5 is rotated. By this, strip 50 is preferably completely wrapped around assembly 5, while assembly 5 is moved along retaining surface 202. Thereby, the wrapping process is continuously guided by assembly 5 being in contact at the three contact locations (two rollers 100, one retaining surface 201).

The tension in belt 20 may be maintained constant by means of tension roller bracket 250. As a result, the pressure that belt 20 exerts on assembly 5 is substantially constant, even if assembly 5 has a non-uniform cross section.

Heating elements (not shown) of a known type may be provided in the rolling drum 1 or in the retaining device 2, for example arranged next to a nip roller 23 to support in activating or curing of the adhesive to achieve rapid adhesion.

The wrapping time of each assembly 5 is preferably at most equal to the time taken by the respective seat 10 to travel along retaining surface 202. As such the wrapping time is still a function of the operating speed of at least rolling drum 1. However, the speed at which each assembly 5 is rotated about its axis is much less than the rotational speed of rolling drum 1 and depends foremost on the speed differential between the rolling drum 1 and belt 20.

The system and method according to the invention enable an assembly to be wrapped relatively slowly even while being moved through a wrapping system at a high speed. This permits the wrapping operation to be carried out sufficiently slowly to prevent damage to the products while maintaining a high production rate.

The invention claimed is:

1. System for wrapping an assembly of segments, the system comprising a supply conveyor, a wrapping conveyor and a retaining surface, wherein the supply conveyor is adapted for supplying an assembly of segments to the wrapping conveyor, the assembly of segments comprising at least two segments arranged in an end-to-end relationship with an outer periphery of the assembly being affixed longitudinally to an edge portion of a piece of wrapping material, wherein at least one of the at least two segments of the assembly is a rigid segment with a compressibility higher than about 10 Newton per 1.5 mm; wherein the wrapping conveyor comprises a rolling seat arranged in the peripheral surface of the wrapping conveyor being movable with the wrapping conveyor, the rolling seat comprising a rolling element rotatable relative to the wrapping conveyor for rotating the assembly in the rolling seat; wherein the retaining surface is arranged at a distance to and opposite the peripheral surface of the wrapping conveyor such as to contact the assembly arranged in the rolling seat of the wrapping conveyor, wherein the wrapping conveyor is movable relative to the retaining surface adapted to create a relative movement between the wrapping conveyor and the retaining surface such as to cause rotation of the assembly in the rolling seat along a longitudinal axis of the assembly, thereby providing the assembly with a three-point guiding contact while moving the assembly along the retaining surface and wrapping the assembly with the piece of wrapping material while the assembly is movable along the retaining surface, and wherein the system comprises a pressure applicator or applying pressure to the retaining surface to apply a constant pressure to the assembly.

2. System according to claim 1, further comprising a retaining device arranged in the wrapping conveyor for retaining the assembly in the rolling seat, the retaining device providing a retaining action onto the assembly while the assembly is arranges in the rolling seat.

3. System according to claim 1, wherein the rolling element comprises a pair of rollers arranged parallel to each other and rotatable in a same direction, the pair of rollers being arranged perpendicular to a moving direction of the wrapping conveyor.

4. System according to claim 1, wherein the retaining surface is a surface of an endless belt.

5. System according to claim 1, wherein the retaining surface and a surface of the rolling seat are surfaces adapted to avoid slippage between segments of the assembly of segments and the rolling seat.

6. A cigarette maker comprising a system according to claim 1.

* * * * *